US011180868B2

(12) United States Patent
Perez Rigueiro et al.

(10) Patent No.: US 11,180,868 B2
(45) Date of Patent: Nov. 23, 2021

(54) METHOD FOR PRODUCING ELONGATED STRUCTURES SUCH AS FIBERS FROM POLYMER SOLUTIONS BY STRAINING FLOW SPINNING

(71) Applicants: UNIVERSIDAD POLITECNICA DE MADRID, Madrid (ES); UNIVERSIDAD DE SEVILLA, Seville (ES)

(72) Inventors: Jose Perez Rigueiro, Madrid (ES); Gustavo Victor Guinea Tortuero, Madrid (ES); Manuel Elices Calafat, Madrid (ES); Gustavo Ramon Plaza Baonza, Madrid (ES); Rodrigo Madurga Lacalle, Madrid (ES); Alfonso M. Ganan Calvo, Seville (ES)

(73) Assignees: UNIVERSIDAD POLITÉCNICA DE MADRID, Madrid (ES); UNIVERSIDAD DE SEVILLA, Seville (ES)

( * ) Notice: Subject to any disclaimer, the term of this patent is extended or adjusted under 35 U.S.C. 154(b) by 530 days.

(21) Appl. No.: 16/063,092

(22) PCT Filed: Dec. 15, 2016

(86) PCT No.: PCT/EP2016/081267
§ 371 (c)(1),
(2) Date: Jun. 15, 2018

(87) PCT Pub. No.: WO2017/102989
PCT Pub. Date: Jun. 22, 2017

(65) Prior Publication Data

US 2018/0298523 A1 Oct. 18, 2018

(30) Foreign Application Priority Data

Dec. 18, 2015 (EP) ..... 15382646

(51) Int. Cl.
*D01D 5/14* (2006.01)
*D01D 5/06* (2006.01)
(Continued)

(52) U.S. Cl.
CPC ..... *D01D 5/14* (2013.01); *D01D 4/02* (2013.01); *D01D 4/025* (2013.01); *D01D 5/06* (2013.01); *D01F 4/02* (2013.01); *D10B 2211/22* (2013.01)

(58) Field of Classification Search
CPC .. D01D 5/14; D01D 4/02; D01D 5/06; D01D 4/025; D10B 2211/22; D01F 4/02
See application file for complete search history.

(56) References Cited

U.S. PATENT DOCUMENTS 2,402,846 A 6/1946 Ryan et al.
5,252,285 A 10/1993 Lock
(Continued)

FOREIGN PATENT DOCUMENTS

EP 2021361 A1 2/2009
EP 2489779 A1 8/2012
(Continued)

OTHER PUBLICATIONS

Geng, Liang, et al. "Discovery of beta-form crystal structure in electrospun poly [(R)-3-hydroxybutyrate-co-(R)-3-hydroxyhexanoate](PHBHx) nanofibers: from fiber mats to single fibers." Macromolecules 48,17 (2015): 6197-6205.
(Continued)

*Primary Examiner* — Francisco W Tschen
*Assistant Examiner* — Elisa H Vera

(57) ABSTRACT

A method of molecular self-assembly is disclosed using two interacting streams that are allowed to interact and are subsequently forced through an orifice. A first stream of a dope solution of polymer molecules is extruded out of a
(Continued)

capillary. The dope stream is surrounded by a focusing fluid which is miscible with the dope solution. The interaction between the jet of dope solution and surrounding focusing fluid creates hydrodynamic stretching and allows for extracting solvent from the dope solution. Concentrated polymers within the solution at stretched regions of the jet interact, and finally self-assembly takes place after the fluids are forced through the outlet of a converging nozzle. The formation of the structure can be optionally completed in a coagulating space. The structures thus obtained such as fibers or threads can be wound onto a mandrel.

18 Claims, 9 Drawing Sheets

(51) Int. Cl.
*D01F 4/02* (2006.01)
*D01D 4/02* (2006.01)

(56) References Cited

U.S. PATENT DOCUMENTS 6,116,516 A * 9/2000 Ganan-Calvo .... A61M 15/0065 128/200.21
2007/0256250 A1* 11/2007 Knight ..... C07K 14/43518 8/128.1
2008/0063968 A1* 3/2008 Kinoshita ..... G03G 9/08782 430/110.1
2009/0137781 A1 5/2009 Scheibel et al.
2010/0013115 A1* 1/2010 Breslauer ..... D01D 5/38 264/130
2010/0029553 A1* 2/2010 Scheibel ..... A61P 17/00 514/19.1
2011/0048604 A1* 3/2011 Kwon ..... B29B 15/125 152/451
2014/0234605 A1* 8/2014 Ausen ..... B29C 48/11 428/219
2014/0264985 A1* 9/2014 Sutti ..... D01F 1/10 264/11
2015/0141618 A1* 5/2015 Ishikawa ..... D01F 4/00 530/353
2015/0292114 A1 10/2015 Soderberg et al.

FOREIGN PATENT DOCUMENTS

WO WO169289 A2 9/2001
WO WO3060099 A2 7/2003
WO WO2005017237 A2 2/2005
WO WO2007141131 A1 12/2007
WO WO2015048433 A1 4/2015

OTHER PUBLICATIONS

Hu, Min, et al., "Cell immobilization in gelatin-hydroxyphenylpropionic acid hydrogel fibers," Biomaterials 30.21 (2009): 3523-3531.
Hu, Min et al. "Hydrodynamic spinning of hydrogel fibers." Biomaterials 31 (2010): 863-869.
Lazaris, Anthoula, et al. "Spider silk fibers spun from soluble recombinant silk produced in mammalian cells." science 295.5554 (2002): 472-476.
Elices, M., et al. "Bioinspired fibers follow the track of natural spider silk," Macromolecules 44.5 (2011): 1166-1176.
Yazawa, Masahide. "Spining and Stretching." The Journal of the Society of Chemical Industry, Japan, vol. 63, No. 9, Sep. 5, 1960, pp. 1481-1488.

* cited by examiner

METHOD FOR PRODUCING ELONGATED STRUCTURES SUCH AS FIBERS FROM POLYMER SOLUTIONS BY STRAINING FLOW SPINNING

CROSS-REFERENCE TO RELATED APPLICATION

This application is the U.S. national phase of PCT Application No. PCT/EP2016/081267 filed on Dec. 15, 2016, which claims priority to EP Patent Application No. 15382646.6 filed on Dec. 18, 2015, the disclosures of which are incorporated in their entirety by reference herein.

FIELD OF THE INVENTION

The invention relates to the field of fluid dynamics and more particularly to the use of two interacting fluids forced to go through an orifice to create a fiber or thread of a polymeric material which polymer is dissolved in a solution.

The fiber or thread can be useful for Biomaterials, more specifically for Tissue Engineering, among many other applications.

BACKGROUND OF THE INVENTION

Nature is a continuous source of inspiration for creating new products and processes. In this regard, one of the most solidly established areas in the new field of Biomimetics deals with the production of fibers inspired in their natural counterparts and, in particular, in silk fibers. Silks are defined as fibers spun by arthropods from a protein solution stored in specialized glands and, although a large number of lineages can spin silk fibers, silk production is essentially associated to spiders and some Lepidoptera (butterflies) larvae.

The critical biological functions performed by silks have led to materials with a unique combination of properties. In effect, spider silk shows a combination of tensile strength and strain at breaking that yields the highest work to fracture of any material either natural or artificial, reaching a value of over 500 MJ/m$^3$ for the silk of the spider *Argiope aurantia* which compares favorably with the 50 MJ/m$^3$ measured for high performance Kevlar fibers. However, requiring a large amount of work in order to fracture a silk thread is not the only desirable characteristic of silk fibers that can be transferred to artificial materials. It has also been found that the mechanical properties of spider silk can be tailored predictably and reproducibly by a simple method that consists of immersing the fiber in water, allowing it to supercontract and stretch it in water up to a given length. This convenient feature, in turn, depends on the existence of a ground state to which the fiber can revert by supercontraction in water, independently of its previous loading history.

A factor of further importance regarding these fibers is the extreme biocompatibility of silk proteins and silk fibers. In general, silk fibers do not generate an immune response. Thus, it is almost impossible to generate antibodies against them. However, they can be modified either genetically or chemically to alter the biological response they generate.

The outstanding properties of silks are the result of a subtle interplay between the chemical composition, physical microstructure and processing.

Silk proteins—fibroins—are characterized by sequences that have been conserved for over 100 million years, which include four basic amino acid motifs: -An- (wherein n ranges from n=2 to n=20), -GA-, -GGX- (wherein X is an amino acid other than Glycine) and -GPG- in the major ampullate gland silk of orb-weaving spiders. Some of these four basic motifs appear in other silks spun by orb-weaving spiders and in the silks of other spider lineages, and the motif -GA- appears even in the silk spun by silkworms (*Bombyx mori*). The -An- and -GA- motifs lead to the formation of nanocrystals by piling up β-pleated sheets. The β-nanocrystals maintain the structural integrity of the material by preventing the protein chains from sliding and making silk fibers insoluble, despite being spun from an aqueous protein solution. In addition to their nanocrystalline phase, silks also present an amorphous phase. Little is known about this second phase, even though that it controls most of the properties of these fibers.

In addition to composition and microstructure, processing plays a critical role in the properties of silks. In contrast to most artificial fibers that require high temperatures and/or the use of harsh solvents in the spinning process, silks are spun from mild solutions at room temperature. Even more impressive is the ability to produce water insoluble fibers from aqueous solutions in a process that is completed in fractions of a second. Once again, although the details of silk spinning are not known in full detail, there is general consensus on their essential features. In this regard, the basic event in the transition from protein solution to solid material is the formation of the β-nanocrystallites, which is critically dependent on the presence of the crystallite-forming motifs in the sequence of the proteins and is believed to occur in two consecutive steps as described below.

The first step involves the organization of the proteins in the gland lumen. There are two models, not necessarily incompatible, which describe this organization: the liquid crystal model and the micellar model. In both models, the protein molecules acquire a given order in the solution (alternatively, liquid crystalline order or the formation of micellar structures) which decreases the viscosity of the fluid, imparts it a non-newtonian character and prepares the proteins for the subsequent conformational changes that lead to solidification.

An increase in the pH of the solution at this step might play a leading role in this conformational change. The influence of the pH in the spinning process was initially suggested by the identification of proton pumps in the final region of the gland. This finding was subsequently backed up by the observation of conformational changes leading to β-pleated secondary structure formation in silk proteins in solution after decreasing pH. Finally, the identification of a motif in silk proteins that acts as a switch that modifies the conformation of the protein with pH has rendered additional support to this model.

The conformational changes which the proteins undergo in the first step make them susceptible to solidifying in a second step, which consists of imposing shear stresses on the fluid solution that induce relative displacements between the proteins. The importance of this mechanism in the spinning process was recognized in some early works, since it is assumed that the full transition to β-pleated sheets in the proteins is only completed after being subjected to sufficient mechanical stress that leads to the reorganization and assembly of silk proteins. It was also found that the large variability exhibited by natural spider silk fibers was controlled by the stresses exerted on the fiber during the final part of the spinning process, and that this process preserves the total volume of the fiber. The requirement of a stress-induced extensive protein reorganization to complete the spinning process of silk fibers appears to be a singular feature of these fibers that distinguishes their processing from other spinning routes. Initial estimations of the stresses that lead to fiber formation yielded values of 40 MPa, as calculated from rheological data. Alternative measurements on the silking stresses exerted on fibers not subjected to additional stretching subsequently set a new upper limit of 20 MPa, although the actual value might be well below this stress level, since the silking stresses might be affected by processes different from the fiber formation, i.e. friction of the fiber with the gland walls.

The singular properties of silk fibers naturally led to an increased interest in the production of artificial fibers that would share the main features of the natural materials. Initial attempts were restricted to systems in which natural proteins were dissolved and then spun, yielding the so-called regenerated fibers. The advent of Genetic Engineering techniques and the possibility of synthetizing recombinant proteins inspired in natural fibroins extended this initial methodology to include the so-called bioinspired fibers, obtained by spinning solutions of genetically engineered proteins. At present production of regenerated and/or bioinspired fibers is performed by using either conventional wet spinning or electrospinning methods. However, both approaches are essentially based on the chemistry of the solutions involved and/or the sequences of the silk or silk-bioinspired proteins mostly disregarding any explicit consideration of the stress-induced reorganization of the dope proteins.

Initial attempts of spinning silk fibers were based on the wet-spinning process. (Yazawa, S. (1960). Spinning of concentrated aqueous silk fibroin solution. *J. Chem. Soc. Japan* 63, 1428-1430). The essential mechanism of wet spinning that allows the production of fibers consists of the removal of the solvent, in which the fiber-forming molecules are dissolved, so that the molecules are allowed to interact with each other and form a solid fiber.

Consequently, the basic elements that define any wet spinning process are:

- Dope: solution of the fiber-forming molecules in a convenient solvent;
- Spinneret: Orifice through which the dope is forced to pass, creating a jet;
- Coagulating bath, in which the solvent of the dope is removed; and
- Take-up mandrel, on which the solid fiber winds.

In particular, Yazawa prepared the first regenerated fibers from an aqueous solution of silk fibroin as dope and ammonium sulphate solution as coagulating bath.

Since this early attempt to spin natural silkworm silk fibroin regenerated fibers, most proposed procedures have consisted of dissolving degummed silk fibers in a polar solvent to create the dope, and using a fluid miscible with the solvent as coagulating bath. Previous to the preparation of the dope, a degumming step was performed in order to remove the protein coating of sericin that covers the fibroin fibers. Degumming is frequently performed in boiling water using $Na_2CO_3$ as an additive. An alternative and more recent approach consists of degumming using an autoclave with no additives. The degumming process might play an important role in the spinnability of the system and in the properties of the spun fibers, since it can degrade the natural fibroin proteins, leading to a decrease of the molecular weight of the fibroins. Subsequent attempts (presented briefly as dope solvent/coagulating bath pairs) include: ortho phosphoric acid/ammonium sulphate solution, Matsumoto-Uejima solvent (lithium bromide-ethanol-water)/methanol, hexafluoro-2-propanol/methanol, formic acid/methanol, calcium nitrate-water/methanol, water/air, and water/ammonium sulphate, among others. It is worth mentioning the use of the system N-methyl morpholine oxide (NMMO) as dope solvent and methanol as coagulating bath, since the fibers spun with this process yielded values of the work to fracture comparable to natural silk fibers if subjected to post-spinning drawing in water.

Interestingly, spinning of bioinspired fibers from recombinant proteins solutions has followed a very similar approach since the early attempts by the DuPont company (Lock, R. L. (1993). Process for making silk fibroin fibers. U.S. Pat. No. 5,252,285), and it has led to a larger number of patents. One of the major concerns with regard to the production of bioinspired fibers are the difference in the sequence between the natural and the recombinant proteins. Since the rationale behind the large molecular weight of the natural proteins remains unclear, many authors have concentrated on assessing that fibers were produced from the artificial proteins. Consequently, some of the initial attempts (Karatzas, C. N. et al. Methods and apparatus for spinning spider silk protein, WO03060099A2 (2003); Lazaris, A., Arcidiacono, S., Huang, Y., Zhou, J. F., Duguay, F., Chretien, N., Welsh, E. A., Soares, J. W. and Karatzas, C. N. (2002). Spider silk fibers spun from soluble recombinant silk produced in mammalian cells. *Science* 295, 472-476) used conventional wet spinning processes in which the main mechanisms that led to the solidification of the fiber were related with the diffusion of the different chemical species. No specific analysis was performed on the interaction between the different fluids (except for the aforementioned diffusion processes) or on the mechanical stresses to which the dope was subjected. Despite applying conventional spinning, it was possible to identify spinning conditions that led to the production of high performance recombinant fibers (Elices, M., Guinea, G. V., Plaza, G. R., Karatzas, C., Riekel, C., Agullo-Rueda, F., Daza, R. and Perez-Rigueiro, J. (2011). Bioinspired Fibers Follow the Track of Natural Spider Silk. *Macromolecules* 44, 1166-1176).

An increased knowledge on the natural spinning mechanism led to the development of new processes that tried to control the chemical evolution of the dope during the process. In this regard, it was proposed (Knight, D. P. Apparatus and method for the selective assembly of protein, WO2005017237A2, (2005)) a system in which the dope goes through a semipermeable tube which is in contact with one or several different chemical species, so that the composition of the dope varies along the tube. Subsequent proposals have substituted the semipermeable solid wall of the previous technique by the interaction between the protein solution and a second fluid. Thus, a micro fluidic system for the production of different silk products such as spheres, nanofibrils and threads was described (Scheibel, T. et al., Microfluidic device for controlled aggregation of spider silk, WO2007141131A1, (2007)), in which the dope is allowed to interact with a second fluid in a microdevice that comprises at least three microchannels from three different inlets. The interaction between both fluids controls the chemical evolution of the dope and allows creating the different structures mentioned in the patent. A similar strategy in which the flow of a given fluid is controlled by the presence of a second co-flow has been also proposed for the formation of cell-seeded gelatin-based hydrogels (Hu, M. et al., Cell immobilization in gelatin-hydroxyphenylpropionic acid hydrogel fibers, Biomaterials, 30, (2009), 3523-3531) and silk micron and submicron spheres (Omenetto, F. et al., Synthesis of silk fibroin micro- and submicron spheres using a co-flow method, WO2015048433A1, (2015)). However, no explicit mention is found in any of these works to the stresses involved in the process, except for general comments on their importance with regard to the formation of the fibers.

With regard to the forces to which the proteins are exposed during the spinning process, electrospinning differs from conventional wet spinning in the presence of very high (albeit difficult to control) stresses. In a typical electrospinning setup, a polymer solution is pumped through a needle which works as electrode. An intense electric field generated by a high voltage source is established between the needle and a collector device. When the applied potential is high enough as to overcome surface tension, a jet of polymer solution erupts from the droplet resulting in the formation of a Taylor cone. The fiber is formed during the fly of the jet from the needle to the collector as a result of the evaporation of the solvent. The electrospinning process is controlled by a large number of parameters related with the composition of the dope, the conditions of the flow and the surrounding environment. Among these, it is worth mentioning the effect exerted on the microstructure and size of the spun fibers by the electrical potential, the viscosity and electrical conductivity of the dope and its surface tension which, in turn, control the stresses to which the proteins are subjected.

Several systems were proposed for electrospinning regenerated or bioinspired fibroin fibers. Initial attempts followed the previous experience on wet spun regenerated fibers and used hexafluoro-2-propanol as solvent for the dope. A major difference between wet spinning and electrospinning is the absence of a coagulating bath in the latter, so that solvent removal depends on its volatility. Alternatively, formic acid has also been used as fibroin solvent, and there are reports of electrospun fibroin fibers from aqueous dopes, although using water as solvent usually requires the addition of other macromolecules, for instance collagen, in order to get a spinnable dope. Compared with wet spinning, electrospinning allows obtaining fibroin fibers with sizes ranging from nanometers to micrometers and in several formats including yarns, mats and tubes. However, the mechanical properties of the individual fibers produced by electrospinning tend to be much lower than those of the fibers produced by wet spinning. The large stresses that can arise during this process were exemplified by Gong et al. (Macromolecules 2015, 48, 6197-6205), since they found a strain-induced metastable β-form crystal structure, with the extended chains adopting a planar zigzag conformation, in the macroscopically aligned electrospun nanofibers of poly[(R)-3-hydroxybutyrate-co-(R)-3-hydroxyhexanoate] (PHBHx) collected across the air gap on aluminum foil and on the tapered edge of a high-speed rotary disk.

The previous discussion shows that one of the main shortcomings that are encountered when spinning regenerated or bioinspired fibroin fibers using either conventional wet spinning or electrospinning techniques is the control of the stresses exerted on the dope. Comparison of the natural spinning system in both silkworms and spiders with the artificial techniques suggests the convenience of (1) exerting the stress after a given interaction time between the dope and the co-flow that allows for the required conformation changes of the proteins to occur and (2) using a procedure that ensures (and possibly) controls the values of the stresses on the proteins.

Thus, there remains a need for new processes and techniques for the production of polymer fibers that complies with both requirements.

SUMMARY OF THE INVENTION

The present invention is based on new discoveries in the fields of spinning in bioinspired and natural systems (silkworm and spider silk) and of fluid mechanics. The inventors have found that the flow focusing technique represents a convenient starting point which, after suitable modifications, allows developing the novel straining flow spinning (SFS) process proposed herein that complies with the both requirements set forth above. As originally conceived flow focusing aimed at the generation of a continuous steady jet of a given fluid upon focusing by a coflowing (or focusing) fluid (initially a gas). The hydrodynamical features of the focused fluid allowed the formation of a meniscus with a conelike shape from which the jet was formed. The energy source was the pressure drop of the focusing gas, when forced through an orifice. This basic scheme was based on the usage of immiscible compounds as focusing and focused fluids and rendered the surface tension of the focused fluid a primary role. In addition, the setup was intended for minimizing the shear stresses exerted by the focusing fluid on the focused fluid. The ability of this procedure for producing fibers under these conditions (immiscibility of the fluids and low shear stresses) was proved by the manufacturing of glass fibers from molten glass as described in U.S. Pat. No. 6,116,516A. In this regard, straining flow spinning as proposed in the present invention is based on creating a stable framework for the interaction of the dope and focusing jets that controls the chemical interaction between them and also allows controlling the magnitude and timing of application of the stresses exerted on the polymer molecules as a result of their traversing an orifice.

A method of molecular self-assembly from polymer solutions and in particular molecular self-assembly to produce elongated structures such as fibers, preferably comprised of peptides/proteins, is disclosed. The method comprises extruding a stream of a dope solution of polymer molecules out of a capillary feeding source into a surrounding environment which environment is comprised of a focusing fluid miscible with the dope solution. The dope jet is stabilized by the presence of the focusing fluid and the interaction of the dope with the focusing fluid results in selectively extracting solvent from the doping solution, which solvent is extracted into the surrounding environment of the focusing fluid. Polymer concentration of the dope solution at the stretched region of the stream reaches a level such that contact among polymer molecules within the stretched stream undergo molecular self-assembly, and said molecular self-assembly may form a structure such as a thread or fiber in the form of an elongated solid structure (normally, cylinder-like) as a result of the stresses exerted on the proteins as a consequence of their traversing an orifice located in a nozzle downstream of the point of contact between the dope and the focusing fluid. The formation of the structure may be preferably completed in a coagulating space. Finally, the elongated structure of self-assembled polymer molecules is continuously extracted, for instance by collecting it in a take up device.

The capillary-nozzle system presents the following parameters:

- distance between the end of the capillary and the outlet of the nozzle between 400 and 15000 μm,
- diameter of nozzle outlet between 250 and 800 μm, and
- dope capillary tapering angle of 10° to 90°.

The method of the invention makes it possible to create polymer fibers, in particular silk fibers, under a wide range of conditions. This is accomplished in different ways by varying: the composition of the dope, the hydrodynamic conditions of the spinning process, the geometry of the capillary-nozzle system, the composition of the focusing fluid, the composition of the coagulation fluid, and the relative velocity between streams and take-up device. The invention provides for spinning under mild conditions in terms of the composition of the solutions used.

An embodiment of the invention is the method wherein the length of the convergent region of the nozzle is between 2000 to 4000 μm.

Another embodiment of the invention is the method wherein the nozzle outlet is circular.

Another embodiment of the invention is the method wherein the nozzle outlet is a slit in a plate. In such an embodiment, any reference to the diameter of the nozzle outlet herein must be understood as relating to the minimum transverse dimension.

Another embodiment of the invention is the method wherein the dope and the focusing fluids go through a converging nozzle and enter a coagulating bath. FIGS. 3 and 4 relate to an example of system with a coagulating bath.

Another embodiment of the invention is the method wherein the dope and the focusing fluids go through a converging nozzle and enter a coagulating tube (or coagulating capillary). FIGS. 5 and 6 relate to an example of system with a coagulating tube (or coagulating capillary). In a particular embodiment, the coagulating tube has a circular section. In another particular embodiment, the coagulating tube has a rectangular section, more particularly the coagulating tube may be a space created by two parallel plates.

Another embodiment of the invention is the method wherein the dope solution and the focusing fluid go through the outlet of the converging nozzle and enter a coagulating space, wherein the nozzle outlet is a slit in a plate and wherein the coagulating space is a space created by two parallel plates.

Another embodiment of the invention is the method wherein the focusing fluid comprises an alcohol (such as methanol, ethanol, etc.), acetone, an aqueous salt solution or mixtures thereof. In a particular embodiment, the focusing fluid is or comprises water and ethanol.

Another embodiment of the invention is the method wherein the coagulating bath comprises an alcohol (such as methanol, ethanol, etc.), acetone, an aqueous salt solution or mixtures thereof. In a particular embodiment, the focusing fluid is or comprises ethanol.

Another embodiment of the invention is the method, wherein the pH of the focusing fluid and/or the pH of the coagulating bath differ from the pH of the dope solution by more than 0.1. The pH of the dope usually ranges from about 3 to about 9. For the focusing fluid and the coagulation bath the pH generally ranges from about 3 to about 7. An embodiment of the invention is the method wherein the polymer in the dope solution is comprised of amino acids making up peptides, polypeptides and/or proteins. In a preferred embodiment, the polymer comprises at least one amino acid motif selected from the group consisting of: -GA-, -$A_n$-, -GPG- and -GGX-, wherein n ranges from n=2 to n=20 and where X is an amino acid other than Glycine. In another preferred embodiment, the polymer solution is a solution of peptides/proteins comprised of from at least 5 residues (amino acids) to proteins which are not restricted in length, so that it might reach values of the molecular mass of the order of 250 kDa, comparable to the natural silk proteins, or even higher.

Another embodiment of the invention is the method wherein the ratio of the dope flow rate $Q_d$ to the focusing flow rate $Q_f$ is less than about 0.7%.

Another embodiment of the invention is the method wherein the ratio of the dope flow rate $Q_d$ to the focusing flow rate $Q_f$ is less than about 0.2%.

Another embodiment of the invention is the method wherein the spun fiber or thread is retrieved on a take up device such as a rotating mandrel or a suction instrument.

Another embodiment of the invention is the method wherein the ratio between the speed of the fiber or thread at the take up device and the speed of the focusing fluid ranges between about 20% and about 500%.

Another embodiment of the invention is the method wherein the ratio between the speed of the fiber or thread and the take up device and the speed of the focusing fluid ranges between about 50% and about 200%.

Another embodiment of the invention is the method wherein the distance between the capillary and the outlet orifice of the nozzle is at least about 10% that of the diameter of the nozzle outlet.

Another embodiment of the invention is the method wherein the rate of flow of the dope solution and focusing fluid flow is at least $10^{-20}$ $m^3/s$.

Another aspect is a device suitable for carrying out the method molecular self-assembly of the present invention, which comprises:

means for injecting a dope solution of polymer molecules into a capillary;

means for injecting a focusing fluid into a convergent nozzle that surrounds the capillary and is provided with an outlet that the dope and focusing fluid are forced to traverse, thereby resulting in molecular self-assembly of the polymer molecules; and a take up device suitable for extracting an elongated structure of self-assembled polymer;

wherein the capillary-nozzle system presents the following parameters:

distance between the end of the capillary and the outlet of the nozzle between 400 and 15000 μm, diameter of nozzle outlet between 250 and 800 μm, and dope capillary tapering angle of 10° to 90°.

Another aspect of the invention is an elongated structure such as a thread or fiber obtainable by the method as described herein.

Further aspects of the invention is the use of an elongated structure obtainable by the method of the invention for producing biomaterials as well as the resulting biomaterials. Another embodiment of the invention is to use elongated structures, threads and fibers produced by the method in order to produce biomaterials, provide structural integrity in tissue engineering components and decrease immune responses generated by such components.

Another embodiment of the invention is to create structures using the threads and fibers produced by the method of the invention in order to produce basic scaffolds which have sufficient mechanical properties and structural integrity in terms of tensile strength while not generating an immune response and as such are useful in constructing various types of biomaterials including implants and artificial tissues.

Another embodiment of the invention is the use of the elongated structures produced by the method of the invention in order to produce artificial ligaments, tendons and components of other body parts including vessels.

Another embodiment of the invention is the use of the fibers and threads produced by the method of the invention in the regeneration of nerves by providing a basic scaffolding or back bone structure which acts as guidance for axons.

Another embodiment of the invention is to use fibers produced by a method of the invention to simulate natural spider silk, silk from silk worms and the use of such fibers in weaving together fabrics in different fields of engineering, including textile engineering, industrial engineering and various types of protective clothing.

The present invention may be used in the field of Biomaterials, more specifically in the field of Tissue Engineering. Tissue Engineering requires the fabrication of scaffolds of biocompatible materials. Although several materials in different formats (gels, membranes, sponges and fibers) have been proposed, there is a need for scaffolds with sufficient mechanical properties in terms of tensile strength, strain at breaking and work required to fracture. The invention can be used for therapeutic treatments of ligaments and tendons. High performance fibers are spun with this procedure as scaffolds for this type of regenerative therapy, since they provide sufficient mechanical strength, can be used from the initial steps of the healing process. Fibers produced by the invention are useful for the regeneration of nerves and, in particular, for the guidance of axons. Production of artificial fibers with properties comparable to those of natural spider silk are useful as high performance fibers in different fields of engineering including textile engineering, and industrial engineering.

These and other objects, advantages, and features of the invention will become apparent to those persons skilled in the art upon reading the details of the method and resulting product as more fully described below.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Included in the drawings are the following figures.

DETAILED DESCRIPTION OF THE INVENTION

Figure 1:
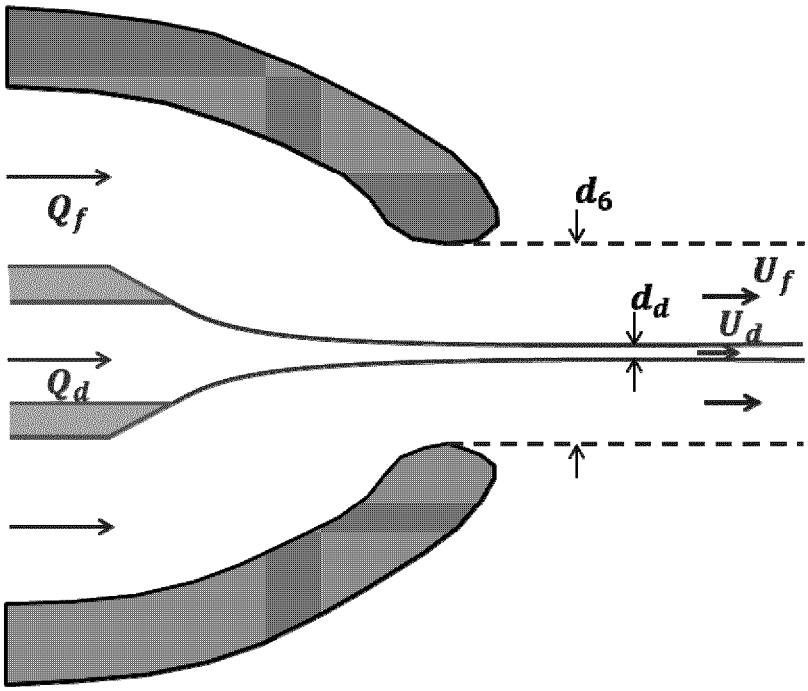
FIG. 1 is a schematic cross sectional view of components used in one embodiment of the method of the invention showing the end portion of the capillary-nozzle system. The figure is schematically labeled with respect to different speeds, flow rates and some important geometric parameters useful in understanding aspects of the invention. Ud, Qd, Uf and Qf stand for the dope speed, dope flow rate, focusing fluid speed and focusing fluid flow rate, respectively. The geometrical parameters correspond to the diameter of the nozzle outlet, $d_6$, and the diameter of the dope stream, $d_d$.
Figure 2:
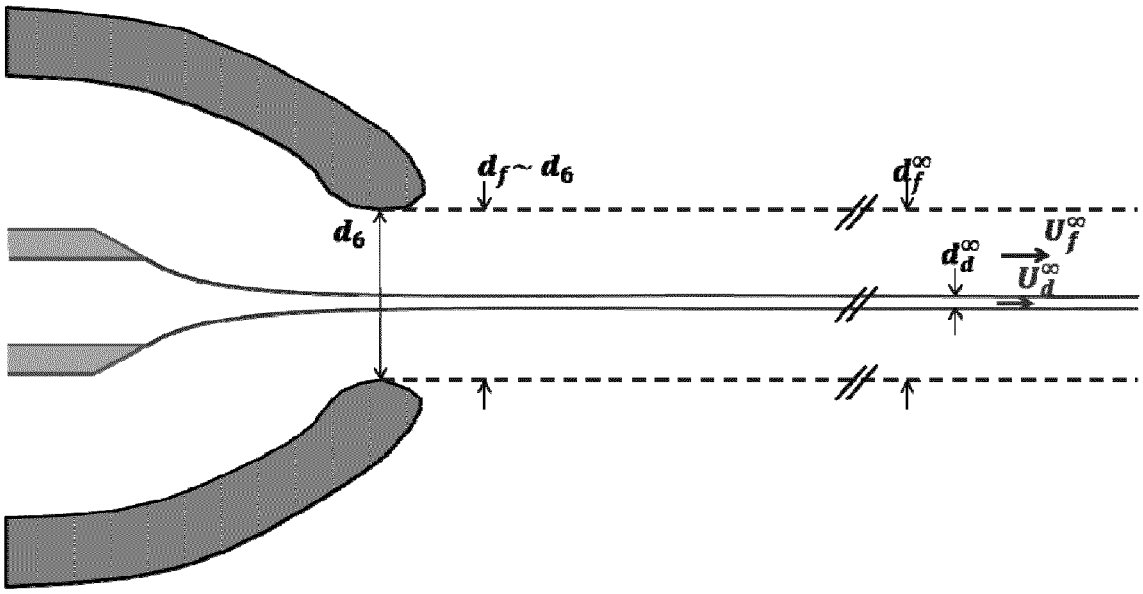
FIG. 2 is a cross sectional schematic view of components used in one embodiment of the method of the invention showing different geometric parameters with different speeds and flow rates at large distances from the capillary-nozzle system outlet.
Figure 3:
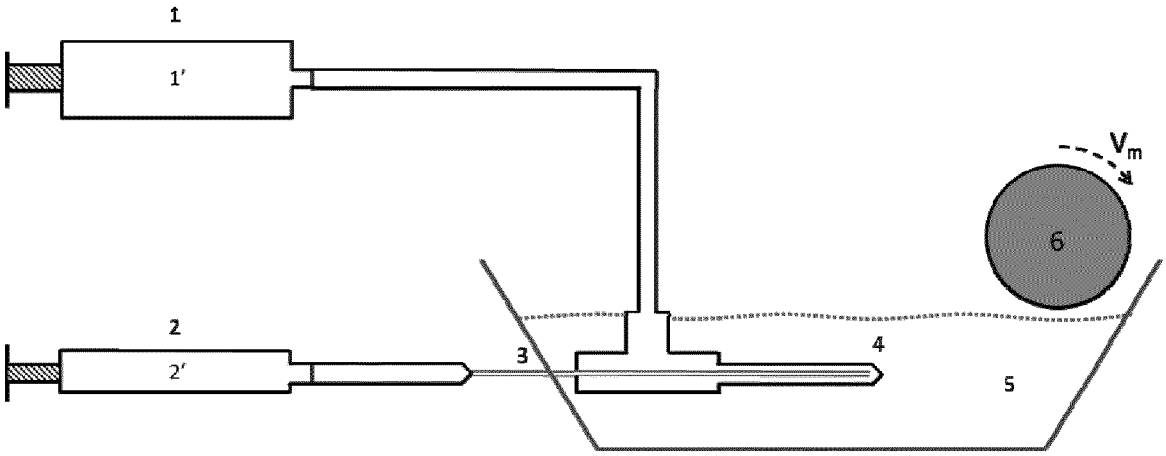
FIG. 3 is a schematic cross sectional view of a system suitable for carrying out the method of the invention showing a spinning process using the capillary-nozzle system and a coagulating bath. Reference signs are as follows: syringe connected to a pump (1), focusing fluid (1'), syringe connected to a pump (2), dope (2'), capillary (3), nozzle (4), coagulating bath (5), and take up device such as a mandrel (6)
Figure 4:
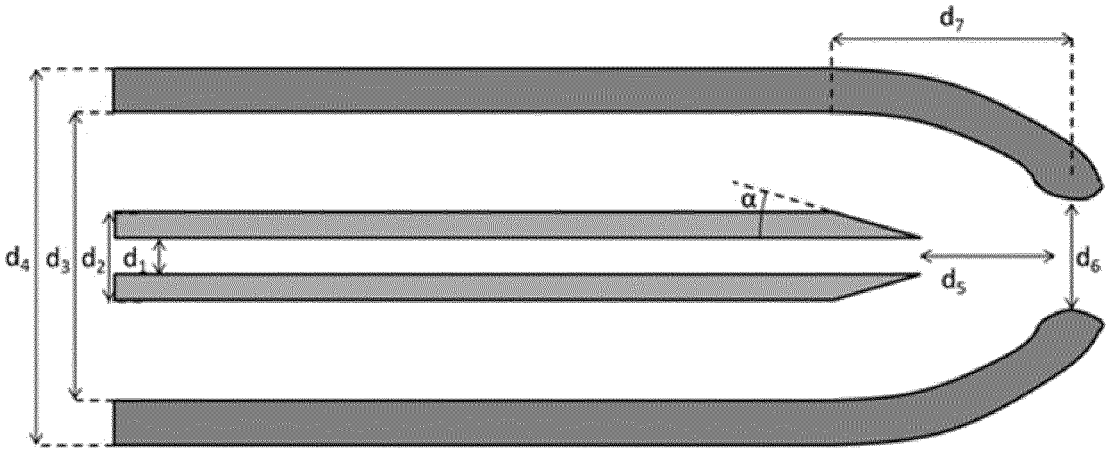
FIG. 4 is a cross sectional schematic view of components of the invention showing details of the capillary-nozzle system geometry of an embodiment with the coagulating bath (for instance, FIG. 3) while including relevant dimension information. Reference signs are as follows: inner diameter of the capillary ($d_1$), outer diameter of the capillary ($d_2$), inner diameter of the nozzle ($d_3$), outer diameter of the nozzle ($d_4$), distance between the end of the capillary and the outlet of the nozzle ($d_5$), diameter of the outlet in the nozzle ($d_6$), length of the convergent region of the nozzle ($d_7$), and tapering at the end of the capillary ($\alpha$).
Figure 5:
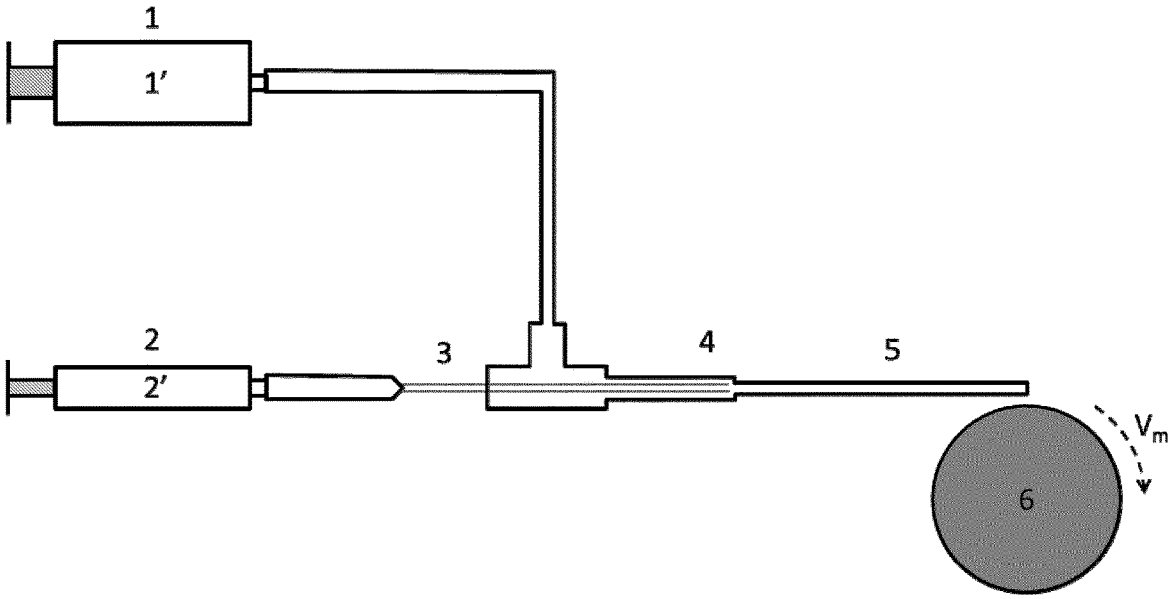
FIG. 5 is a schematic cross sectional view of an extrusion device used in a spinning process using the capillary-nozzle system with a coagulating tube or capillary. Reference signs are as follows: syringe connected to a pump (1), focusing fluid (1'), syringe connected to a pump (2), dope (2'), dope capillary (3), nozzle (4), coagulating tube (capillary) (5), and take up device such as a mandrel (6).
Figure 6:
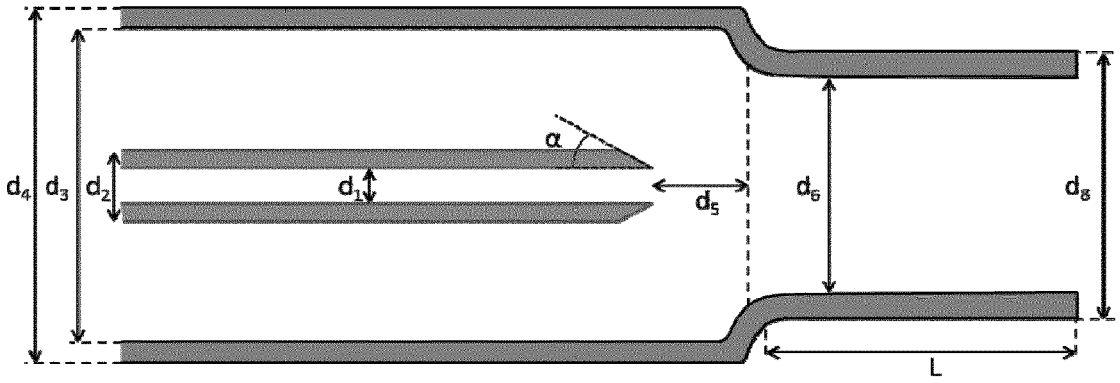
FIG. 6 shows specific aspects of components used in connection with one embodiment of the method of the invention showing details and relevant dimensions of the capillary-nozzle system coupled to a coagulating tube (or capillary). Reference signs are as follows: inner diameter of the capillary ($d_1$), outer diameter of the capillary ($d_2$), inner diameter of the nozzle ($d_3$), outer diameter of the nozzle ($d_4$), diameter of the outlet in the nozzle ($d_6$), and outer diameter of the coagulating capillary ($d_8$), distance between the dope capillary and the nozzle outlet ($d_5$), length of the coagulating capillary (L), and tapering at the end of the dope capillary ($\alpha$), FIG. 7 consists of a graph showing data relating to spinnable conditions in terms of focusing fluid velocity ($U_f$) and dope initial velocity ($U_d$) for the geometrical parameters: $d_6$=400 μm, $\alpha$=90° and $d_5$=1000 μm; in composition of dope: Low Molecular Weight (LMW, protein obtained after a degumming process in $Na_2CO_3$) 20% fibroin concentration in acetate buffer 0.5 M with a pH=5.5; focusing fluid and coagulating fluid: absolute ethanol; described in connection with the present invention. Filled circles: continuous spinning, Open circles: no spinning, Squares: insoluble fibers are retrieved from spinning, Dashed lines: limits of the spinnable regions for the corresponding speed of the take-up mandrel ($V_m$).

A method of producing elongated structures such as fibers or threads from polymer solutions, in particular silk protein solutions is disclosed. The method uses at least two miscible fluids which are brought into contact by injecting a dope solution of polymer molecules into a surrounding flow of a focusing fluid and, after an interaction time, are forced through an orifice. Both fluids undergo molecular exchange mainly by either or both of diffusion, and reactions while the two fluid streams are in contact. The straining flow between the inner dope solution and outer focusing fluid, to which the name of the process refers, is believed to result from the reduction in the cross sectional area of the dope solution stream at the outlet of the nozzle. After going through the nozzle outlet the fibers enter a coagulating space, which can be for instance a coagulating bath or a coagulating tube (or coagulating capillary). Spun fibers or threads may be recovered in a take up device, such as a rotating mandrel.

Without being bound to any theory, the applicants consider that the process results in elongated structures including fibers and threads produced by the combined effect of (a) polymer molecules capable of physical organization at micrometer scale based on appropriate matching of given regions along their sequence, such as that obtained with silk and silk-related proteins, (b) the diffusion of the chemical species between the dope, the focusing fluid and, possibly, an external coagulating bath, (c) the relative displacement induced in the dope proteins by the interaction of the dope solution and the focusing stream as a result of traversing an orifice, and (d) in some embodiments, the relative speed between the fluid streams and the rotating mandrel or the like used as take up device. Thus, the method makes it possible to carry out the spinning of fibers having a wide range of microstructures and properties.

The invention includes, in essence, four primary components and four secondary components, each of which are described below in further detail. The primary components are referred to below as the dope feeding capillary, dope, focusing fluid and nozzle. These components are referred to, at times, by somewhat different names as will be understood by the context. For example the dope feeding capillary is also referred to as the feeding source, the "dope" is also referred to as the dope solution or polymer solution. The "focusing fluid" is also referred to as a surrounding environment which is comprised of a fluid used to focus and stretch the dope solution. The "nozzle" is also referred to as nozzle outlet or simply outlet. As will be understood from the further description and examples below, the invention can be carried out with the basic primary components. However, by including certain secondary components, it is possible to supplement the results obtained and provide more commercially useful fibers.

Description of the Elements and Procedure

Dope Feeding Capillary.

The capillary creates a stream of polymer solution (dope) such as a protein solution. The material of the dope feeding capillary is not restricted in principle, except for its compatibility with the dope and focusing fluid composition. A possible choice is silica for the capillary. The capillary is tapered at the end to obtain a smooth flow of focusing fluid, in particular the dope capillary tapering angle (α) ranges from 10° to 90°.

Dope.

The main parameters that define the composition of the dope are (a) the chemical nature of the polymers (i.e. natural (regenerated) silk fibroin, recombinant silk proteins, etc.), (b) the concentration of the polymers, (c) the pH of the solution, and (d) the addition of other chemical species (e.g. salts).

According to one embodiment, the dopes used for the spinning are aqueous solutions of silk fibroin with a concentration that range from about 3 to about 40% (w/v). In a more particular embodiment, the fibroin concentration of the dope is from about 3 to about 20% (w/v) for high molecular weight fibroin, and a preferred range is from 15 to 20% (w/v). Whereas when the dope is a solution of low molecular weight fibroin the concentration range usually ranges from about 15 to about 40% (w/v), being a preferred range from about 30 to about 40% (w/v).

Additionally the solution can be pH adjusted using different buffers like acetic acid 0.5 M for acid pHs or sodium carbonate 0.5 M for alkaline pHs. On the other hand, salts like $CaCl_2$, $MgCl_2$ or NaCl can be added to the dope to stabilize the fibroin chains in solution. The salt concentration can be preferably fixed in a range from 0 M to 1 M.

In preferred polymer used in the dope solution is high molecular weight silk fibroin, preferably obtained from degumming silkworm silk cocoons in water (with a weight ratio of 1/50) at 121° C. in an autoclave for 1 hour.

Focusing Fluid.

The focusing fluid surrounds the dope solution and creates a stable stream of the dope under the conditions imposed by the geometry of the system, and by the flow rates of the dope and the focusing fluid itself. As described below, the focusing fluid is believed to initiate the coagulation process of the dope by (a) varying the composition of the dope or (b) by leading to a first stress-induced reorganization of the dope polymer or both (a) and (b).

Nozzle.

The combination feeding capillary-nozzle determines the geometry of the system and allows establishing three critical parameters of the process, the distance between the end of the capillary and the outlet of the nozzle (($d_5$), between 400 and 15000 μm), the diameter of the outlet in the nozzle (($d_6$), between 250 and 800 μm) and the distance and shape of the convergent region of the nozzle. Formation of a stable straining stream demands that the region geometry should not lead to instabilities, which requires a convergent geometry. In a particular embodiment, the length of the convergent region of the nozzle ($d_7$) is between 2000 to 4000 μm. The material of the nozzle is not restricted in principle, except for its compatibility with the dope and focusing fluid composition. A possible choice is glass for the nozzle.

The secondary components of the invention are:

Coagulating Bath.

The coagulating bath completes the solidification process of the elongated structure (fiber, thread, etc.) by inducing chemical changes, and consists of a container, which may have one side open to the atmosphere, that allows maintaining the streams of dope and focusing fluid for a sufficient distance after going through the nozzle outlet.

Confined Coagulating Region.

The confined coagulating region consists of a limited space in which the dope and focusing streams remain stable for a sufficient distance to allow coagulation after going through the nozzle outlet. It can be implemented, for instance, with a coagulating tube or capillary whose cross sectional area is reduced downstream.

Coagulating Fluid.

The use of a coagulating bath allows using a coagulating fluid that can be the same or different from the focusing fluid.

The coagulation fluids can be grouped according to the nature of the main components. In an embodiment of the present invention, the coagulant used is selected from an alcoholic coagulant, a polyethylene glycol coagulant, glycol, glycerol and a salt-based coagulant.

Alcoholic coagulants are mixtures of alcohol (e.g. ethanol or isopropanol) and water. The ratio of alcohol:water usually ranges from 100:0 to 60:40. Additionally, acetic acid can be added to the coagulation fluid to a final concentration that may range from 0 to 0.5 M.

Polyethylene glycol coagulants are made of PEG aqueous solutions, typically in a range from about 10 to about 50% (w/v). The PEG molecular weight can generally range from about 2 to about 8 kDa. Additionally, acetic acid can be added to the coagulation fluid to a final concentration that may range from 0 to 0.5 M.

Glycol and glycerol may also be used as coagulants.

Salt-based coagulants are for instance ammonium sulphate or potassium phosphate solutions.

Take Up Device.

The spun fiber or thread is retrieved on a take up device from where it can be collected. Take up devices are, for instance, a rotating mandrel or a suction instrument. A post-spinning drawing step, either in air or in a different environment can be added. Retrieval of the fiber is characterized by the take up drawing ratio, DR1, defined as the ratio between the speed of the dope at the nozzle outlet and the linear speed of the take up mandrel. The post-spinning drawing step is characterized by the post-spinning draw ratio, DR2, defined as the ratio between the linear speed of the take up mandrel and the linear speed of the post-spinning drawing mandrel.

Without being bond to any theory it is believed that production of fibers with the straining flow spinning procedure implies the following fundamental processes: Formation of nanocrystals by the dope polymers, interaction of the dope and the focusing streams, shear stresses exerted on the fibers leading to their relative displacement in the dope stream when traversing the nozzle outlet, and creation of a stable focusing stream in the coagulating space.

Formation of Nanocrystals by the Dope Polymers.

Straining flow spinning requires that the polymer molecules of the dope form nanocrytalline regions upon solidification. Exemplary representative of this type of molecules are silk fibroins. Natural silk fibroins of either silkworm or spiders, and related silk-bioinspired proteins are characterized by a small number of sequence motifs that allow the formation of solid elongated structures, for instance fibers. These motifs are basically -GAGAGS- (silkworm silk) and -An- (spider silk, with n ranging from 5 to 10). Solidification is the result of the assembly of these motifs in structures known as β-nanocrystals. The study of the natural silk spinning systems has revealed that the process of formation of the nanocrystals from the soluble protein dope consists of two steps. Initially, variations of the pH and removal of water molecules from the dope solution induce conformational changes in the proteins that lead to their reorganization. Subsequent relative displacement of the contacting proteins leads to further conformational changes and the creation of nanocrystals.

Interaction of the Dope and the Focusing Streams.

The solidification process is at least initiated, and could even be completed to some extent, through the interaction between the dope and the focusing streams. In parallel with the natural system, the first effect of this interaction is the modification of the chemical composition of the dope. This modification, in turn, depends on the diffusion of the different species from or to the dope and the focusing streams. In principle, the solvent molecules of the dope should diffuse to the focusing stream, increasing the effective concentration of protein in the dope stream. Additionally, some chemical species, such as protons, might diffuse from the focusing to the dope stream. In the particular case of protons, this type of diffusion would induce a change in the pH of the dope, which is relevant for the solidification in a natural system.

To achieve an efficient diffusion process, a number of conditions on the focusing stream is preferably met: (1) Dope and focusing fluid should be miscible, (2) the length of the focusing stream should be long enough so as to allow sufficient diffusion of the dope solvent, (3) flow rates of the dope and focusing streams should be such that all along the process the dope stream is always confronted with non-saturated focusing fluid, so that the interchange of chemical species between the dope and the focusing fluid is effective. These conditions represent significant deviations from the flow focusing technology as described specifically in U.S. Pat. No. 6,116,516 "Stabilized capillary microjet and devices and methods for producing same". The '516 patent indicates that the fluids used in the flow focusing processes should be immiscible and devote a detailed discussion to the influence of the surface tension between both fluids on the process. The '516 patent also teaches that the maximum length of the microjet obtained is 50 mm, which is below the values for the production of fibers with the present procedure, which typically exceed a length of 100 mm.

According to one embodiment of the present invention, the flow rate of the dope is fixed between about 1 and about 50 μl/min. In particular, great results were obtained with low flow rates, in the range from about 3 to about 9 μl/min. The spinning can be performed in a wide range of flow rates of the focusing fluid, for instance from about 0.1 to about 20 ml/min.

Shear Stresses in the Dope Stream and Relative Displacement of the Proteins.

The fiber formation supposedly requires the relative displacement of the contacting polymer molecules, so that the regions susceptible to forming a crystalline phase are aligned. Simultaneously, the reorganization of the molecules favors interactions that eventually lead to fiber formation. In this regard, it is critical to reach a final polymer concentration in the dope that allows contact among proteins (or other polymers) in an environment that fosters relative displacements. The proposed technology allows the relative displacement of the proteins in the dope at two different steps. Initially, the difference between the flow rates of the dope and focusing streams induces a first mechanical effect on the dope which is simultaneous in time with the chemical interaction between both fluids. It is a singular feature of SFS that it allows exerting a further mechanical stress on the dope when the dope and the focusing fluid move along the converging geometry of the nozzle and eventually traverse the nozzle outlet. In this regard, the interaction between the dope and the focusing fluid extends along the $d_5$ length within the nozzle, and the molecules in the dope are subjected to mechanical stresses when traversing the nozzle outlet. This way the effects of chemical interaction and mechanical forces on the molecules of the dope are largely uncoupled.

The characteristic axial length of the focusing region is summarized as $d_7$, which reflects the rate at which the focusing fluid accelerates from its passage around the feeding capillary of diameter $d_2$ towards the discharge orifice of diameter $d_6$. Specifically, for a given shape of the focusing nozzle given by a function $g(z;d_3,d_6,d_7)$, where z is the axial coordinate from the exit of the feeding capillary, the acceleration undergone by the focusing fluid at any point along the axis can be very approximately expressed as:

$$a = \frac{-2Q_f^2}{g^5}\frac{dg}{dz},$$

For example, for a shape of the focusing nozzle given by the function:

$$g(z;d_3,d_6,d_7)=(d_3+d_6+(d_3-d_6)\mathrm{Tan}\,h(2(1-2z/d_7)))/2,$$

the acceleration approximately takes the form:

$$a = \frac{2^7(d_3-d_6)\mathrm{Sech}(2(1-2z/d_7))Q_f^2}{(d_3+d_6+(d_3-d_6)\mathrm{Tanh}(2(1-2z/d_7)))^5 d_7},$$

as long as $d_7$ is sufficiently larger than $d_3$. This acceleration imposes the local rate of axial stretching undergone by the focusing stream at any point along the axial length. Anyone skilled in the art may observe that this acceleration is maximum very close to the exit of the nozzle, and that most of the initial region after the exit of the feeding capillary is dominated by a slow motion compared to that of the high straining rate region around the exit of the focusing nozzle. This clearly separates the focusing region into two ones: (i) a first region where the dope is dominated by molecular diffusion processes that for example may lead to a change in pH, and (ii) a second region (downstream of the first one) dominated by a high straining and stress rate.

The possibility of exerting mechanical stresses on the dope proteins after a given interaction time between the dope and the focusing fluid is characteristic of this technology and represents a major difference with respect to other technologies such as those presented in WO03060099A2, WO2005017237A2, WO2007141131A1 and WO2015048433A1.

Creation of a Stable Focusing Stream in the Coagulating Bath or Confined Coagulating Region.

The final solidification of the fiber can be favoured by extending the interaction between the dope and the focusing fluid within the coagulating bath or confined coagulating region, which implies the creation of a stable stream. The creation of a stable stream mainly depends on (1) the combined geometry of the dope feeding capillary and the nozzle, (2) the viscosity of the focusing fluid and, (3) if different from the latter, on the viscosity of the coagulating fluid. To a lesser extent it might also be influenced by (4) the viscosity of the dope. In certain embodiments, formation of a stable stream is favoured by a convergent geometry for the profile of the inner side of the nozzle (i.e. smaller inner diameter close to the nozzle outlet). The geometry of the nozzle represents a major difference compared with U.S. Pat. No. 6,116,516 and WO 01/69289 A2 "Methods for producing optical fiber by focusing high viscosity liquid", since both patent documents require either divergent (U.S. Pat. No. 6,116,516) or convergent-divergent (WO 01/69289 A2) geometries. The formation of a stable stream of the focusing fluid is not indicated in any of the aforementioned patents, since the flow focusing effect is produced by a variation of pressure from the pressure chamber to the outer environment. In this regard, the stable microjet from the solution or melt in the former patent documents is formed due to pressure difference in the focusing fluid which prompts a smooth emission of material from a stable capillary cusp.

Simplified Model of Some Basic Parameters of the Straining Flow Spinning Process A basic model of the straining flow system can be formulated as follows:

The relationship between the flow rate and speed of the dope can be established from the continuity equation as:

$$U_d \sim \frac{Q_d}{d_d^2} \tag{1}$$

and that of the focusing fluid as:

$$U_f \sim \frac{Q_f}{d_6^2 - d_d^2} \sim \frac{Q_f}{d_6^2} \tag{2}$$

where Ud, Qd, Uf and Qf stand for the dope speed, dope flow rate, focusing fluid speed and focusing fluid flow rate, respectively. The geometrical parameters correspond to the diameter of the nozzle outlet, $d_6$, and the diameter of the dope stream, $d_d$. The latter varies with increasing distance from the capillary outlet. The parameters are indicated in FIG. 1.

The diameter of the dope stream, $d_d$, can be calculated from the boundary layer theory, which assumes that the shear stresses at the boundary layer of the dope and focusing streams are equal. Application of this theory leads to the equation:

$$\mu_f\rho_f U_f^3 \sim \mu_d\rho_d U_d^3 \tag{3}$$

Where μf (μd) and ρf (ρd) correspond to the viscosity of the focusing fluid (dope) and density of the focusing fluid (dope), respectively.

Combination of equations (1)-(3) leads to the equation:

$$d_6 \sim d_6\left(\frac{\mu_d\rho_d Q_d^3}{\mu_f\rho_f Q_f^3}\right)^{1/6} \tag{4}$$

That establishes a relationship between $d_d$ and the geometrical and hydrodynamic parameters of the system. Equation (4) can be expressed in terms of the Reynolds number of the dope and focusing fluids as:

$$Re_d = \frac{\rho_d Q_d}{\mu_d d_d};\ Re_f = \frac{\rho_f Q_f}{\mu_f d_f} \tag{5}$$

-continued $$d_d \sim d_6\left(\frac{Re_d}{Re_f}\right)\left(\frac{\rho_f}{\rho_d}\right)^{2/3}\left(\frac{\mu_d}{\mu_f}\right)^{4/3}$$

For sufficiently large distances to the nozzle outlet, the previous analysis can be simplified using the continuity equation and assuming equality of the speeds of the dope and focusing fluid at the boundary.

$$U_d^{\infty} \approx U_f^{\infty} \tag{6}$$

Assuming that the lateral size of the dope stream is much smaller than that of the focusing fluid:

$$d_f^{\infty} >> d_d^{\infty}$$

The following relationship can be established:

$$Q_f \approx \pi/4(d_f^{\infty})^2 U_f^{\infty} \tag{7}$$

Since by the equation of continuity:

$$Q_d \approx \pi/4(d_d^{\infty})^2 U_d^{\infty} \tag{8}$$

And applying equation (6), it is finally found that:

$$\frac{Q_d}{Q_f} = \left(\frac{d_d^{\infty}}{d_f^{\infty}}\right)^2 \Rightarrow d_d^{\infty} = d_f^{\infty}\left(\frac{Q_d}{Q_f}\right)^{1/2} \tag{9}$$

The hypotheses of the simplified model at large distances from the nozzle outlet are strictly true for the coagulating capillary embodiment and can be considered as an approximate value for the coagulating bath embodiment. The assumption of mass conservation was experimentally validated as shown below.

At this point, the description of the process has proceeded by taking advantage of the prevalent role of the relative displacement of the molecules in the formation of the fiber. In this context, the stresses required to induce these relative displacements are assigned a secondary role, since it is implicitly assumed that the same lateral displacements of the contacting molecules in different dopes are assumed to lead to similar microstructures of the fibers. Following this rationale dopes with different viscosities and, consequently, subjected to different stresses might lead to the same final microstructure as long as the lateral displacements of the macromolecules are comparable. However, it is worth giving at least an estimation of the stresses involved in the process. Such an estimation can be provided by applying Bernouilli's equation to the flow near the nozzle to calculate the pressure drop, and by assuming that all stresses are of the same order of magnitude. The pressure drop is:

$$\Delta p \approx \frac{1}{2}\rho_f \frac{4^2 Q_f^2}{\pi^2 d_6^4} \tag{10}$$

Using typical values of a straining flow process: $\rho f \sim 1000$ kg/m$^3$, $Qf \sim 8 \cdot 10^{-8}$ m$^3$/s (4.8 ml/min) and $d_6 = 400$ μm, a value of $\Delta p \sim 0.2$ kPa is obtained. Equation (10) also shows that stresses increase with increasing values of the focusing fluid flow rate which, assuming a constant value of the dope flow rate, implies smaller values of the ratio $Q_d/Q_f$. As shown below, the improvement of the properties of the fibers for smaller values of the ratio $Q_d/Q_f$ was validated experimentally, in agreement with the theory used to describe the straining flow process.

It is worth indicating that the basic equations of this simplified model including equations (2), (4) and (10) depend critically on the nozzle outlet ($d_6$), which is parameter characteristic of the SFS technology. Under the assumption that the value of the lateral size of the focusing fluid at a long distance from the nozzle outlet, $d_f^{\infty}$, is comparable to the value of the nozzle outlet, $d_6$, equation (9) holds. Equation (9) predicts a dependence of the lateral size of the dope stream at large distances from the nozzle outlet (and, consequently, of the fiber) with the diameter of the nozzle outlet and the ratio between the flow rates of the dope and of the focusing fluid.

As used herein, the term "about" means a slight variation of the value specified, preferably within 10 percent of the value specified. Nevertheless, the term "about" can mean a higher tolerance of variation depending on for instance the experimental technique used. Said variations of a specified value are understood by the skilled person and are within the context of the present invention. Further, to provide a more concise description, some of the quantitative expressions given herein are not qualified with the term "about". It is understood that, whether the term "about" is used explicitly or not, every quantity given herein is meant to refer to the actual given value, and it is also meant to refer to the approximation to such given value that would reasonably be inferred based on the ordinary skill in the art, including equivalents and approximations due to the experimental and/or measurement conditions for such given value.

EXAMPLES

The following examples are put forth so as to provide those of ordinary skill in the art with a complete disclosure and description of how to make and use the present invention, and are not intended to limit the scope of what the inventors regard as their invention nor are they intended to represent that the experiments below are all or the only experiments performed. Efforts have been made to ensure accuracy with respect to numbers used (e.g. amounts, temperature, etc.) but some experimental errors and deviations should be accounted for. Unless indicated otherwise, parts are parts by weight, molecular weight is average molecular weight, temperature is in degrees Centigrade, and pressure is at or near atmospheric.

The following Table shows the explored range of spinning parameters with which fibers were obtained using a coagulating bath. It does not imply that spinning is not possible outside the values indicated in the Table.

| Parameter | Minimum value | Maximum value |
|---|---|---|
| Diameter of Nozzle Outlet (μm), $d_6$ | 250 | 800 |
| Nozzle tube internal diameter (μm), $d_3$ | 1100 | |
| Capillary internal diameter (μm), $d_1$ | 150 | |
| Capillary external diameter (μm), $d_2$ | 360 | |
| Dope capillary-nozzle outlet distance (μm), $d_5$ | 400 | 15000 |
| Dope capillary angle, α | 10° | 90° |
| Length of the convergent region of the nozzle, $d_7$ (μm) | 2000 | 4000 |
| Focusing fluid flow rate (ml/min), $Q_f$ | 0.3 | 16.5 |
| Dope flow rate (μl/min), $Q_d$ | 1 | 50 |
| Take-up mandrel speed (m/min), $V_m$ | 1.3 | 12 |

-continued

| Parameter | Minimum value | Maximum value |
|---|---|---|
| Dope composition | Silkworm silk fibroin (two different molecular weight distributions). Acetate buffer 500 mM, pH = 5.5 Distilled water $CaCl_2$ 1M | |
| Focusing fluid composition | Ethanol/Water: (100/0)-(60/40) Isopropanol/Water: (100/0)-(60/40) Ammonium sulphate PEG (10-30%) | |
| Coagulating bath composition | Ethanol/Water: (100/0)-(60/40) Isopropanol/Water: (100/0)-(60/40) Ammonium sulphate PEG (10-30%) | |

Figure 7:
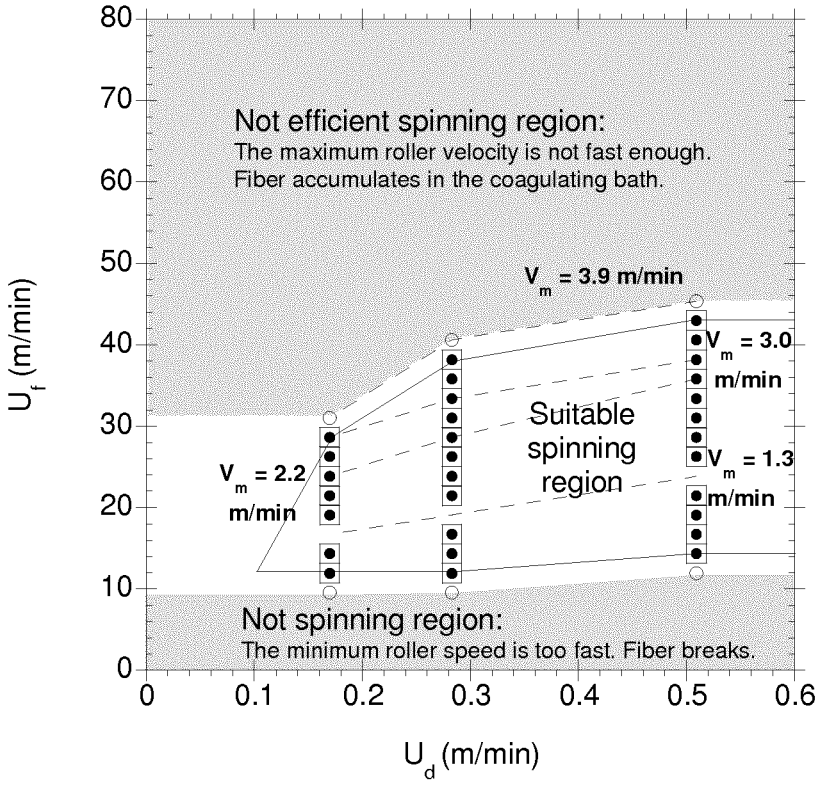

In particular, the following embodiment has led to the production of fibers. Spinnable conditions are shown in FIG. 7 as a function of the take-up mandrel velocity (dashed lines), focusing fluid velocity ($U_f$) and dope velocity ($U_d$).

Geometrical parameters of the embodiment: tapering angle of the capillary, α, 23°, diameter of the nozzle outlet, $d_6$, 400 μm, distance between the end of the capillary and nozzle, $d_5$, 1000 μm, and length of the convergent region of the nozzle, $d_7$, 3500 μm.

Dope composition: Silkworm *Bombyx mori* silk fibroin solution 20% w/v in a buffered aqueous solution with 500 mM acetate and pH=5.5. Fibroin was obtained from silkworm cocoons after a degumming step in boiling water with 0.5% $Na_2CO_3$. This degumming treatment leads to a significant decrease in the molecular weight of silk proteins.

Focusing fluid composition: Absolute ethanol

Coagulating bath composition: Absolute ethanol

Some Properties of the Spun Fibers

Figure 8:
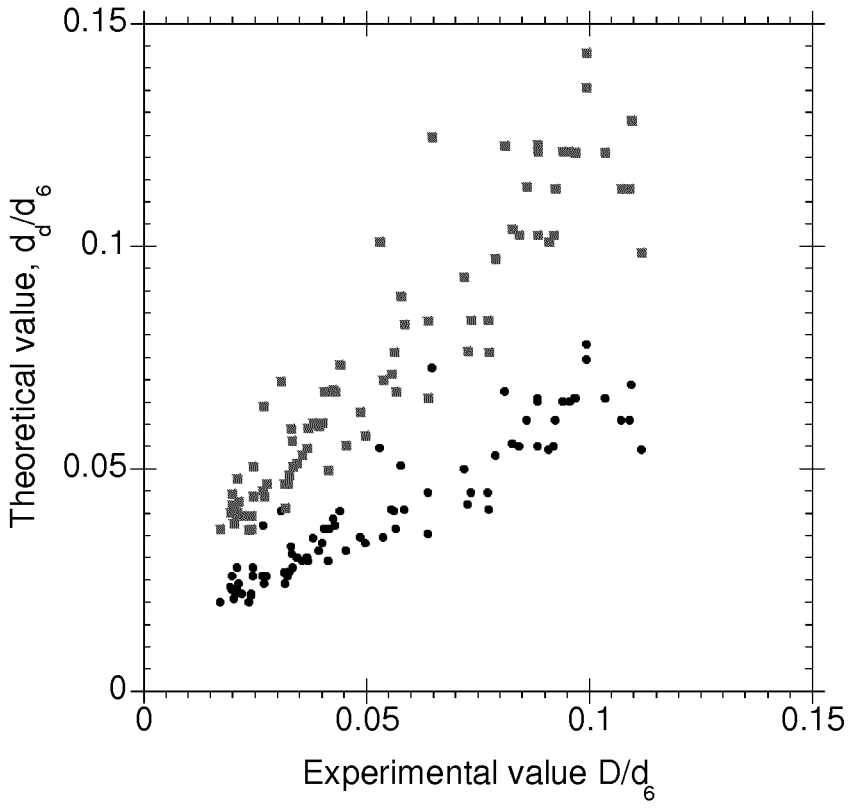
FIG. 8 provides a graph showing data providing a comparison of the experimental value of the ratio $D/d_6$, where D is the diameter of the fiber and $d_6$ the diameter of the outlet of the nozzle, the theoretical values of $d_d/d_6$ where $d_d$ is the calculated value of the diameter of the dope using equation (4) (squares) or equation (9) (circles).

The basic features established in the theoretical analysis of the straining flow process as described above were validated from experimental data. Thus, if the diameter of the fiber, D, is assumed to be equal or at least proportional to the diameter of the dope stream, $d_d$, equations (4) and (9) establish a linear relationship between the ratio $D/d_6$ and the ratio of the flow rates, $Q_d$ and $Q_f$. The exact relationship between both parameters depends on whether the conditions of infinite distance of the stream for the nozzle are admitted (equation 9) or not (equation 4). FIG. 8 represents the experimental values of the functions defined in eqs. (4) and (9) vs. the ratio $D/d_6$, and it shows that a linear relationship is found in both cases.

Figure 9:
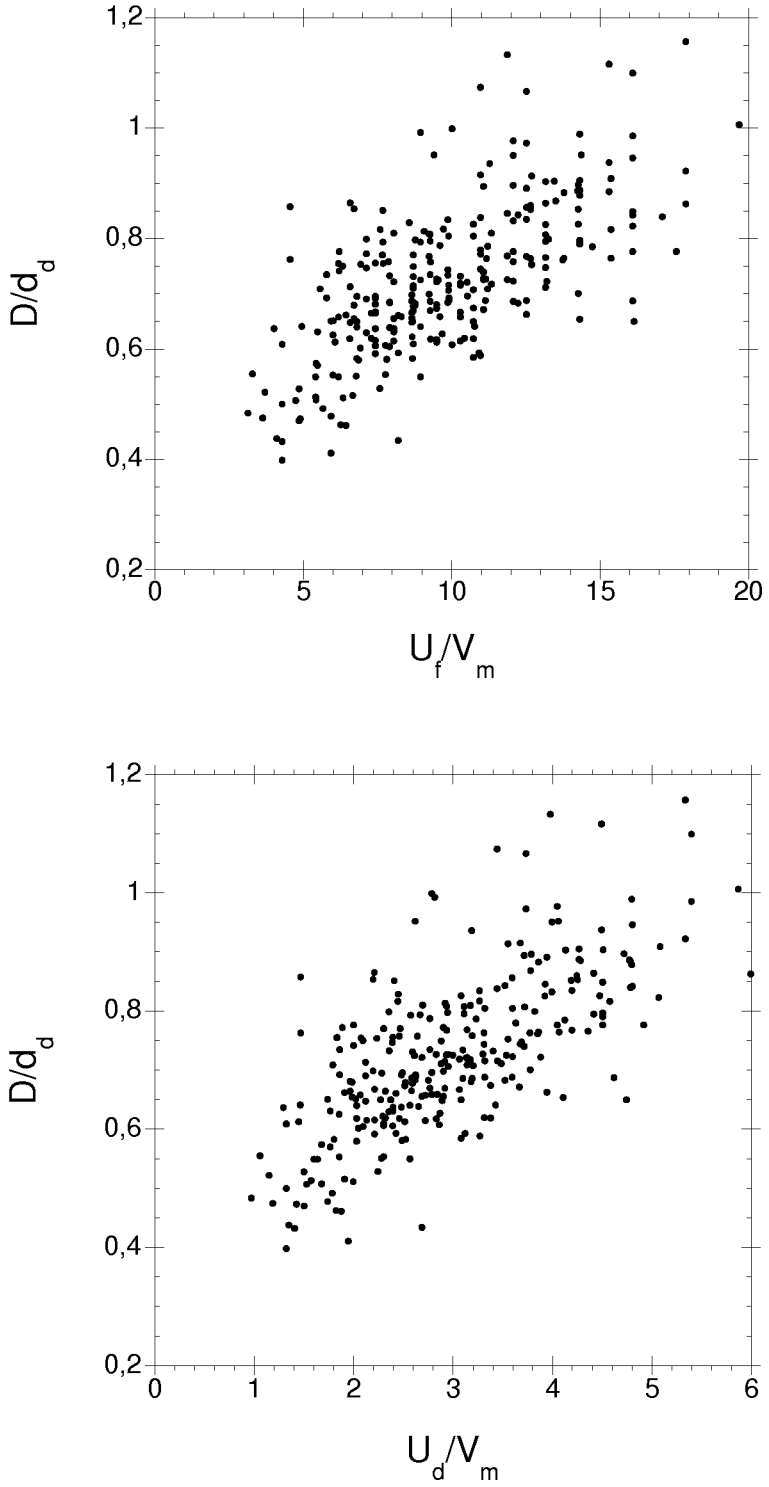
FIG. 9 consists of two graphs showing a comparison of the measured values of the diameter of the fiber and the theoretical value as a function of (the upper graph) the ratio between $U_f$ (focusing flow velocity) and $V_m$ (take-up mandrel velocity) and (the lower graph) the ratio between $U_d$ (dope flow velocity) and $V_m$.
Figure 10:
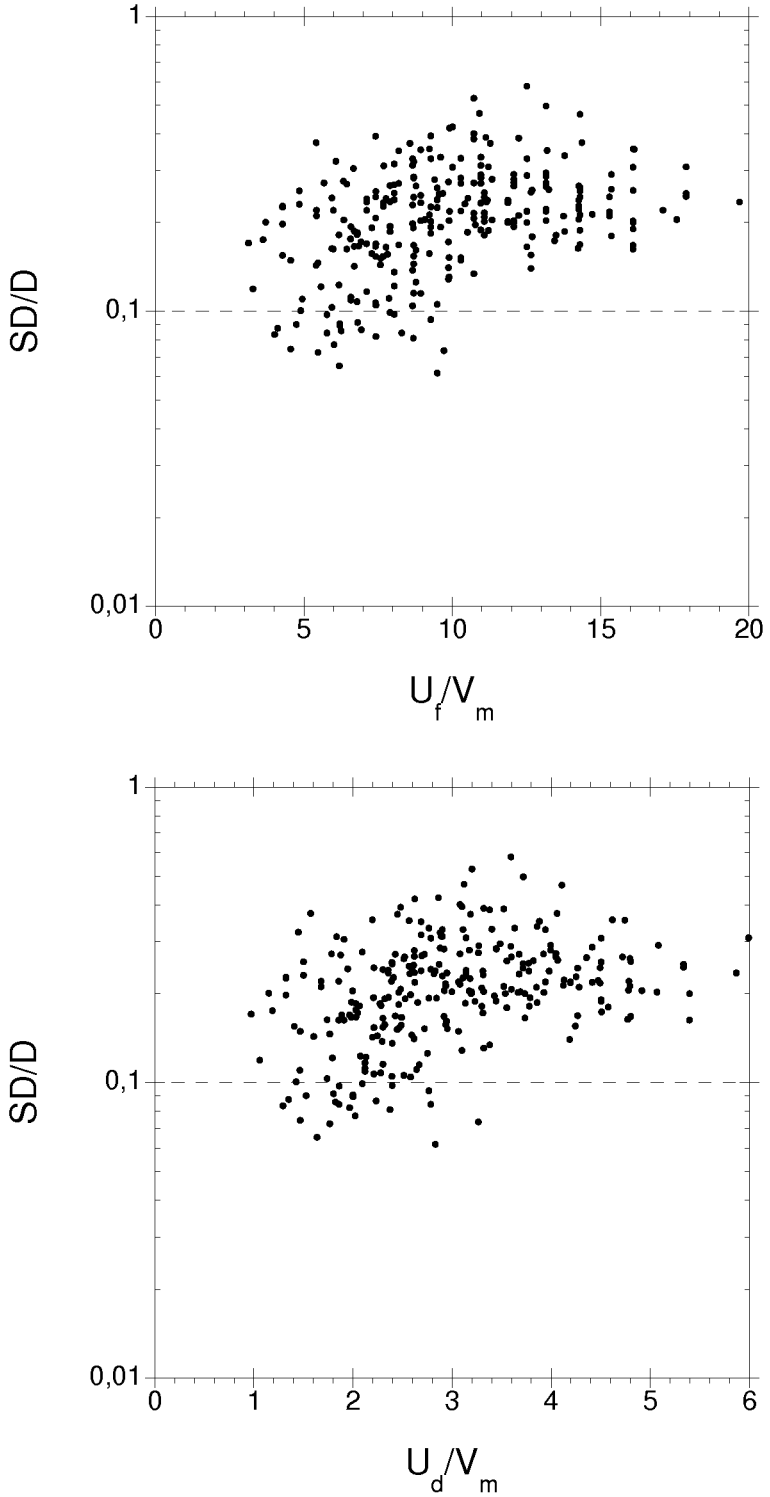
FIG. 10 consists of two graphs showing data demonstrating the quality of the fibers measured as standard deviation of the mean diameter along the fibers length with respect to the mean diameter as a function of the ratio $U_f$/Vm (the upper graph) and $U_d/V_m$ (the lower graph).

The hypotheses of the mass conservation as supposed from the use of the continuity equation and of the increased quality of the fibers for lower values of the ratio $Q_d/Q_f$ are shown in FIGS. 9 and 10. The graphs (a) upper and (b) lower of FIG. 9 compare the diameter of the spun fibers with the theoretical diameter obtained by applying the conservation of mass equation as a function of [graph (a) of FIG. 9] the ratio between the focusing flow velocity, $U_f(=4Q_f/\pi d_6^2)$ and take-up mandrel velocity ($V_m$) and [graph (b) of FIG. 9] of the ratio between the dope initial velocity, $U_d(=4Qd/\pi d_1)$, and take-up mandrel velocity. An excellent agreement is found between both values independently from the ratio between $U_f$, $U_d$ and $V_m$.

Graphs (a) and (b) of FIG. 10 compare the quality of the fibers in terms of the variations observed in the diameter along the fiber measured as standard deviation from the mean diameter as a function of the ratio between $U_f$ and $V_m$, and $U_d$ and $V_m$, respectively. It is observed that lower values of any of the ratios (i.e. $V_m$ larger compared with either flow rate) leads to a significant improvement of the quality of the fiber, in agreement with the increased straining speed and induced protein reorganization associated with lower values of the ratio $U_d/V_m$.

Figure 11:
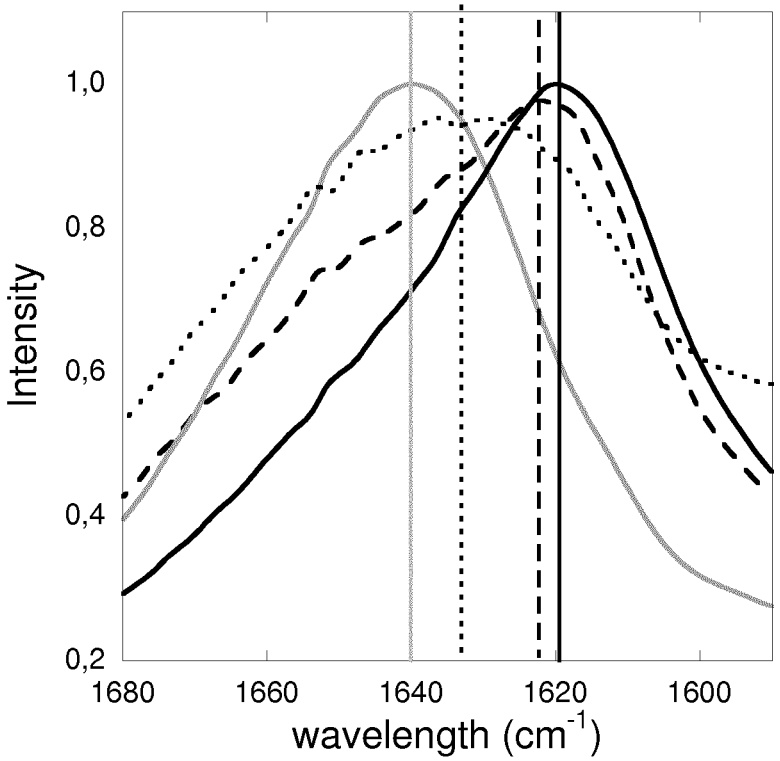
FIG. 11 shows a comparison of the FTIR spectra of regenerated fibers spun under different spinning conditions and silkworm silk fibers. The region of the amide I corresponding to the C═O vibration of the protein back bone is shown as it contains information on the secondary structure of the proteins. Continuous dark line: degummed silkworm silk; dashed line: regenerated fiber from large molecular weight dope; dotted line: regenerated fiber from small molecular weight dope; Continuous light line: fibroin with no β-sheet. The vertical lines indicate the position of the peak.

The possibility of modifying the microstructure of the fibers by varying the spinning conditions is shown in FIG. 11, where the Fourier Transformed Infrared Spectra (FTIR) of different samples are compared. The regions studied correspond to the range between wavelengths 1590 $cm^{-1}$ and 1680 $cm^{-1}$, since these peaks contain information on the amide I bond of the peptide chains. The amide I is produced by the vibration of the C═O group of the protein backbone, and its detailed position yields information on the secondary structure of the protein. The spectrum of natural silkworm silk is also shown, since the peak appearing as approximately 1620 $cm^{-1}$ corresponds to the presence of β-nanocrystals. As indicated above, the presence of the β-nanocrystals is essential for the mechanical performance of natural silk fibers.

Figure 12:
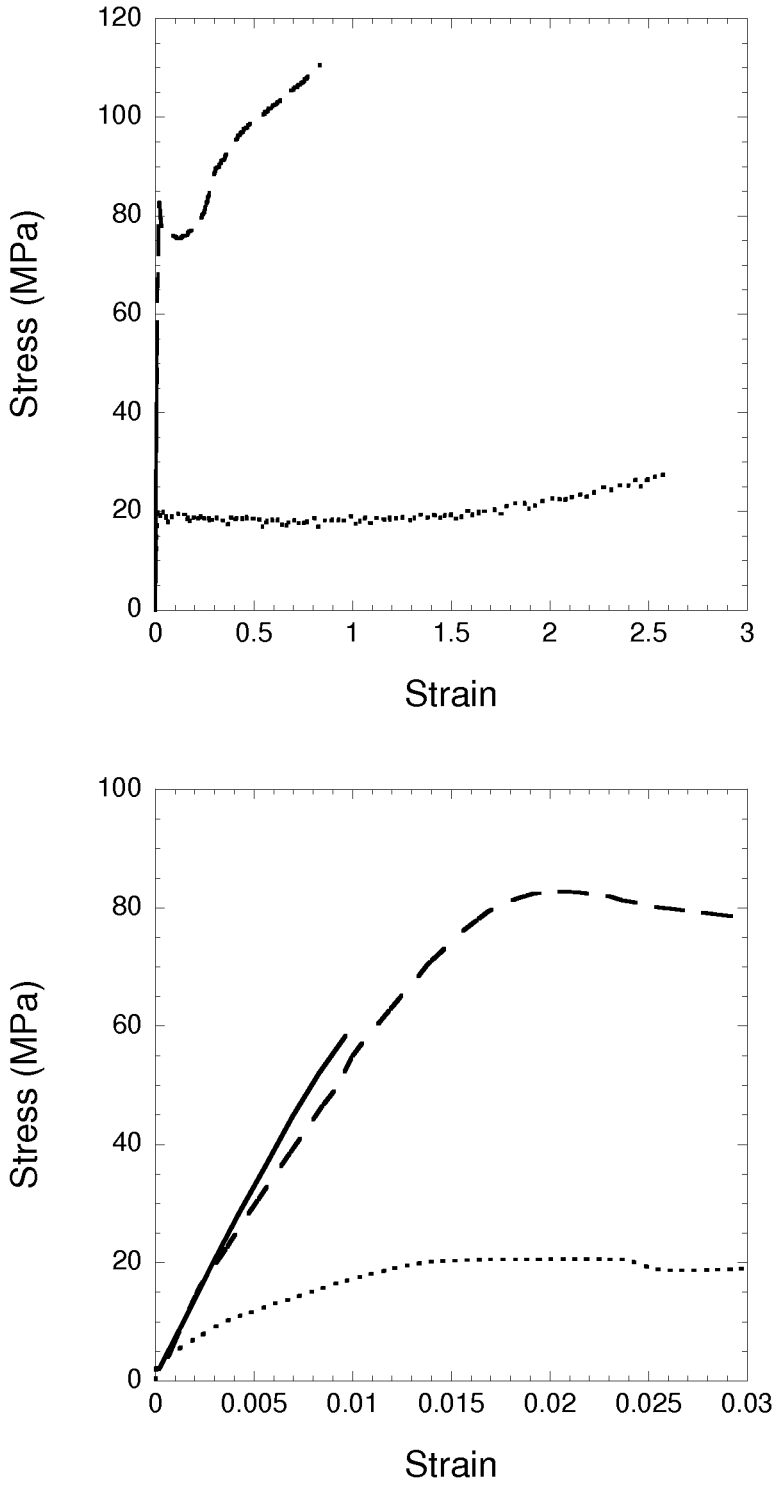
FIG. 12 consists of two graphs showing a comparison of the stress-strain curves of regenerated silk fibers spun under different spinning conditions (upper graph) and a zoom on the initial elastic behavior to facilitate the comparison (lower graph). All the fibers were spun using a nozzle with an orifice diameter of $d_6$=400 μm, a distance between the end of the capillary and the outlet of the nozzle of $d_5$>2000 μm, a flow rate of the dope of $Q_d$=5 μl/min and a roller speed of $V_R$=3 m/min, the flow rate of the focusing fluid was adapted to obtain a continuous spinning Black line: regenerated fiber spun from 30% fibroin concentration, low molecular weight dope and coagulated with ethanol 80% and acetic acid 0.2M; Dashed line: regenerated fiber spun from 16% fibroin concentration and $CaCl_2$ 1 M high molecular weight dope and coagulated with ethanol 80% and acetic acid 0.2M (the fiber was subjected to post-spinning stretching in water, i.e. to wet-stretching); Dotted line: regenerated fiber spun from 8% fibroin concentration and $CaCl_2$ 1 M high molecular weight dope and coagulated with PEG 30%.

The tensile properties of fibers spun under different conditions are shown in FIG. 12 as stress-strain curves. One of the fibers (dotted line), spun under the geometrical conditions: $d_6$=400 μm, α=90°, $d_5$=3500 μm and $d_7$=4000 μm; with hydrodynamic conditions; $Q_d$=5 μl/min, $Q_f$=0.5 ml/min and $V_m$=3 m/min; from a HMW dope with 8% fibroin concentration and $CaCl_2$ 1 M and using PEG 30% as coagulating fluid, shows a strain at breaking of 2.5 and a tensile strength of 28 MPa, which yield a work to fracture of approximately 50 $MJ/m^3$. This value is comparable to the work to fracture of conventional polymeric fibers and, to the authors' best knowledge, is the largest work to fracture reported in regenerated silkworm silk fibers without a post-spinning step. With a post-spinning treatment that consists in stretching the fiber in water, higher tensile strength (110 MPa) and work to fracture (75 $MJ/m^3$), although lower strain at breaking (0.8), can be obtained (FIG. 12, dashed line). These results were obtained using the same geometrical parameters explained above, with hydrodynamic conditions; $Q_d$=5 μl/min, $Q_f$=2.5 ml/min and $V_m$=3 m/min; from a HMW dope with 16% fibroin concentration and $CaCl_2$ 1 M and using ethanol 80% with acetic acid 0.2 M as coagulating fluid.

The preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims.

The invention claimed is:

1. A method of molecular self-assembly, comprising: extruding a stream of a dope solution of polymer molecules out of a capillary into a surrounding environment of a coaxially flowing focusing fluid miscible with the dope solution in a space limited by a convergent nozzle with an outlet that the dope and focusing fluid are forced to traverse;

hydrodynamically stretching the extruded stream of polymer dope solution inside the convergent nozzle due to its interaction with the focusing fluid while simultaneously and selectively extracting solvent into the focusing fluid from the dope solution by molecular diffusion;

wherein polymer concentration in the dope solution at a stretched region of the stream reaches a level such that contact among polymer molecules results in molecular self-assembly of the polymer molecules and subsequently, a stretching is imposed when the dope solution and the focusing fluid are forced through the convergent nozzle outlet; and continuously extracting an elongated structure of self-assembled polymer molecules such as a fiber or a thread;

wherein the capillary-nozzle system presents the following parameters: distance between the end of the capillary and the outlet of the convergent nozzle ($d_6$) between 400 and 15000 pm, diameter of convergent nozzle outlet ($d_6$) between 250 and 800 pm, dope capillary tapering angle ($\alpha$) of 100 to 900, and the rate of flow of the dope solution and focusing fluid flow is at least $10^{-20}$ $m^3/s$.

2. The method according to claim 1, wherein the length of the convergent region of the convergent nozzle ($d_7$) is between 2000 to 4000 μm.

3. The method according to claim 1, wherein the convergent nozzle outlet is circular.

4. The method according to claim 1, wherein the convergent nozzle outlet is a slit in a plate.

5. The method according to claim 1, wherein the dope solution and the focusing fluid go through the outlet of the convergent nozzle and enter a coagulating space.

6. The method according to claim 5, wherein the coagulating space is a coagulating tube.

7. The method according to claim 5, wherein the coagulating space is a coagulating bath.

8. The method according to claim 7, wherein the focusing fluid and/or the coagulating bath comprise an alcohol, acetone, an aqueous salt solution or mixtures thereof.

9. The method according to claim 7, wherein the pH of the focusing fluid and/or the pH of the coagulating bath differs from the pH of the dope solution by more than 0.1.

10. The method according to claim 1, wherein the dope solution and the focusing fluid go through the outlet of the convergent nozzle and enter a coagulating space, wherein the convergent nozzle outlet is a slit in a plate and wherein the coagulating space is a space created by two parallel plates.

11. The method according to claim 1, wherein the polymer comprises amino acids.

12. The method according to claim 11, wherein the polymer is a peptide of at least 5 amino acids.

13. The method according to claim 11, wherein the polymer includes at least one amino acid motif selected from the group consisting of: -GA-, -$A_n$-, -GPG- and -GGX-, wherein n is the number of amino acids A and ranges from 2 to 20 and where X is an amino acid other than Glycine.

14. The method according to claim 1, wherein the ratio of dope flow rate $Q_d$ to the focusing fluid flow rate $Q_f$ is less than 0.7%.

15. The method according to claim 14, wherein $Q_f$ is less than 0.2%.

16. The method according to claim 1, wherein the spun fiber or thread is retrieved on a take up device such as a rotating mandrel or a suction instrument.

17. The method according to claim 16, wherein the ratio of the speed of the fiber or thread at the take up device to the speed of the focusing fluid ranges between 20% and 500%.

18. The method according to claim 16, wherein the ratio of the speed of the fiber or thread at the take up device to the speed of the focusing fluid ranges between 50% and 200%.

* * * * *